US012595792B2

(12) United States Patent
Nagovitsin et al.

(10) Patent No.: US 12,595,792 B2
(45) Date of Patent: Apr. 7, 2026

(54) MAGNETO-HYDRAULIC PLUNGER PUMP UNIT

(71) Applicant: OBSCHESTVO S ORGANICHENNOY OTVETSTVENNOSTYU "MG PAMP", Ufa (RU)

(72) Inventors: Alexandr Vyacheslavovich Nagovitsin, Izhevsk (RU); Dmitry Andreevich Chirkov, Perm (RU)

(73) Assignee: OBSCHESTVO S ORGANICHENNOY OTVETSTVENNOSTYU "MG PAMP", Ufa (RU)

( * ) Notice: Subject to any disclaimer, the term of this patent is extended or adjusted under 35 U.S.C. 154(b) by 0 days.

(21) Appl. No.: 18/718,551

(22) PCT Filed: Oct. 13, 2023

(86) PCT No.: PCT/RU2023/050241
§ 371 (c)(1),
(2) Date: Jun. 11, 2024

(87) PCT Pub. No.: WO2024/107084
PCT Pub. Date: Mar. 23, 2024

(65) Prior Publication Data

US 2025/0270990 A1 Aug. 28, 2025

(30) Foreign Application Priority Data

Nov. 17, 2022 (RU) ..... RU2022129955

(51) Int. Cl.
*F04B 47/08* (2006.01)
*E21B 43/12* (2006.01)

(52) U.S. Cl.
CPC ..... *F04B 47/08* (2013.01); *E21B 43/128* (2013.01)

(58) Field of Classification Search
CPC ..... E21B 17/028; E21B 43/128; F04B 47/08
See application file for complete search history.

(56) References Cited

U.S. PATENT DOCUMENTS

2009/0041596 A1* 2/2009 Ponomarev ..... F04B 47/08 417/375
2017/0194831 A1* 7/2017 Marvel ..... H02K 16/02
(Continued)

*Primary Examiner* — Brad Harcourt
(74) *Attorney, Agent, or Firm* — Boyle Fredrickson, S.C.

(57) ABSTRACT

The invention relates to submersible pump units. The unit comprises submersible electric motor kinematically connected to oil pump, a submersible plunger pump with rod, a hydraulic motor with rod, wherein such hydraulic motor is located within oil tank. There is a linear magnetic coupling with media separator-placed between the hydraulic motor and the submersible plunger pump and made in the form of external and internal cylinders. Each cylinder is made by permanent magnets and which have alternating direction of magnetization. Magnets of the internal cylinder are firmly secured on the upper end of rod. Magnets of the external cylinder are firmly secured on pusher placed inside it. Pusher is made in the form of a hollow rod connected to rod. Media separator is made in the form of a tube with a plug on one side, and on the other side it is hermetically connected to oil tank body. Magnets are located in the inner cavity of separator, and magnets are located on the outer side of separator. The oil pressure inside electric motor and tank is balanced with the pressure of the reservoir fluid. The invention is aimed at improving the reliability of the unit and its service life.

1 Claim, 3 Drawing Sheets

(56) References Cited

U.S. PATENT DOCUMENTS

Figure 1:
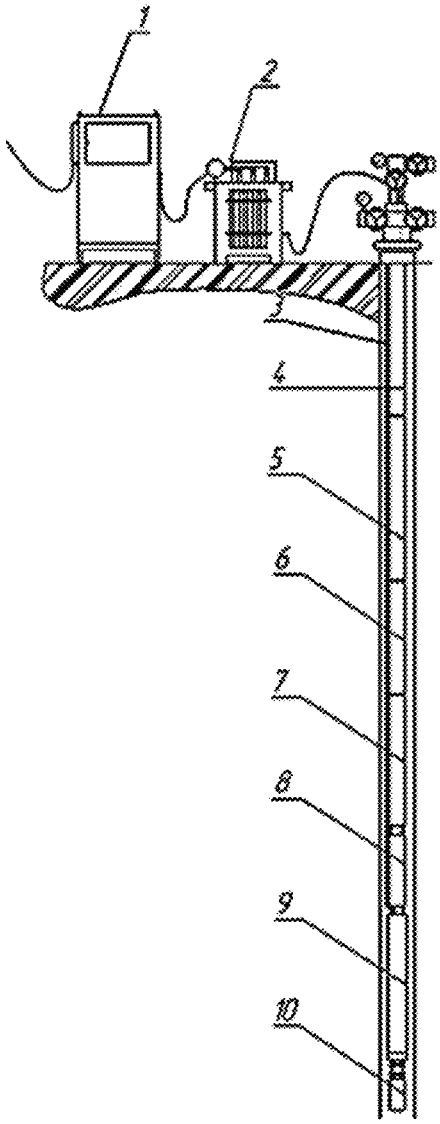

| | | | | |
|---|---|---|---|---|
| 2017/0314546 | A1* | 11/2017 | Minish | F04B 47/06 |
| 2021/0102449 | A1* | 4/2021 | Leonov | F04B 17/03 |
| 2024/0125203 | A1* | 4/2024 | Xiao | E21B 41/0085 |

* cited by examiner

MAGNETO-HYDRAULIC PLUNGER PUMP UNIT

The invention relates to pump units and can be used in the oil industry when operating low-debit wells with complicated oil reservoir characteristics for production of reservoir fluid (a mixture of oil, water, gas, and mineral impurities).

An electro-hydraulic submersible unit known from the prior art comprises a submersible protected electric motor kinematically connected to a drive pump, a plunger service pump, an oil tank, an oil volumetric compensator and hydraulic motor with pistons, in which the bottom-end cavities are connected to suction and discharge lines of the drive pump through automatic reversing valve, and the hydraulic motor pistons are connected to the plungers of the service pump; the unit is equipped with a piston-type hydraulic compensator, in which the head-end cavity is connected to the outlet of the working plunger pump and the bottom-end cavity is connected to the head-end cavities of the hydraulic motor (RU132844, IPC: F04B 47/08, published on Sep. 27, 2013).

An electro-hydraulic submersible unit known from the prior art comprises a submersible electric motor which has hydroprotection and is kinematically connected to a drive pump. The service pump is driven by a hydraulic motor. The mechanism for reciprocating movement of the service pump plunger comprises a power hydraulic cylinder and a return hydraulic cylinder both connected by rods and made to enable switching the positions of the hydraulic distribution valve at the end of the stroke completed by the hydraulic motor rod. The mechanism for connecting the hydraulic cylinder rods is made in the form of joints. The hydraulic drive compensator, which is hydraulically connected to the hydraulic drive drain line, is located in the upper part of the unit, above the service pump, and is equipped with a drain valve. The control unit of the drive pump additionally comprises a device, which protects against reverse rotation of the motor shaft and is made in the form of a check valve. This increases the reliability of the unit by derating the hydraulic drive pump and sealing elements used for the power hydraulic cylinder of the hydraulic motor, as well as by protecting the unit against thermal expansion of the service fluid and reverse rotation of the electric motor shaft. (RU2210003, IPC: F04B 47/08, published on Aug. 10, 2003).

An electro-hydraulic submersible unit known from the prior art comprises a submersible protected electric motor kinematically connected to a drive pump. It comprises a plunger service pump, an oil tank, an oil volumetric compensator, a piston-type hydraulic compensator and a hydraulic motor with pistons connected to the plungers of the service pump. The bottom-end cavities of the hydraulic motor are connected to suction and discharge lines of the drive pump through hydraulic distribution valve. The head-end cavities are hydraulically connected, via throttle openings, with the bottom-end cavity of the hydraulic compensator, in which the head-end cavity is hydraulically connected to the plunger outlet of the service pump through the check valves (RU2579790, IPC: F04B 47/08, published on Apr. 10, 2016). This was accepted as a prototype.

A disadvantage of the known design is its insufficient reliability because, when operating the unit, the extracted fluid flows, during the service stroke of the piston, through the gap between the plunger and the cylinder into the head-end cavity and mixes with the hydraulic fluid of the drive pump, which results in the failure of the entire unit.

The technical problem solved by the invention is to increase the reliability of the pump unit and its service life.

The technical result is to provide force transmission to a plunger pump with a hydraulic motor while ensuring full sealing of the hydraulic motor and submersible electric motor.

The problem is solved and the technical result is achieved by a submersible pump unit comprising a submersible electric motor kinematically connected to an oil pump, a submersible plunger pump with a rod, a hydraulic motor with a rod, wherein such hydraulic motor is located within an oil tank, and the bottom-end cavities of the hydraulic motor are connected, through a hydraulic distribution valve, to suction and discharge lines of the oil pump. Unlike the prototype, there is a linear magnetic coupling with media separator placed between the hydraulic motor and the submersible plunger pump and made in the form of two cylinders (external and internal), one of which is placed inside the other, wherein each cylinder is made by permanent magnets which have alternating direction of magnetization and are placed one above the other, wherein the magnets of the internal cylinder are firmly secured on the upper end of the hydraulic motor rod, and the magnets of the external cylinder are firmly secured on the pusher placed inside it, and the pusher is made in the form of a hollow rod connected to the plunger pump rod, wherein the media separator is made in the form of a tube with a plug on one side, and on the other side it is hermetically connected to the oil tank body by welding or secured to the oil tank by means of a connection thread with grooves with installed rubber seals to ensure hermetic sealing to the inner surface of the oil tank, wherein the magnets of the internal cylinder of the coupling are located in the inner cavity of the media separator, and the magnets of the external cylinder are located on the outer side of the media separator, and in addition, there are intermediate rings of steel placed between the magnets of each cylinder of the coupling, and the oil pressure inside the submersible electric motor and oil tank is balanced with the pressure of the reservoir fluid.

The technical result is achieved by using a linear magnetic coupling with installed media separator. The coupling ensures that the force is transmitted to the plunger pump from the hydraulic motor. During the operation of the unit, there is a reciprocating motion of the hydraulic motor rod, which is transmitted to the plunger pump rod through the pusher due to the restraining forces generated between the coupling magnets, which results in the operation of the plunger pump. This way, the media separator unit ensures that the inner space of the hydraulic motor and electric motor is completely sealed against the penetration of reservoir fluid.

Figure 2:
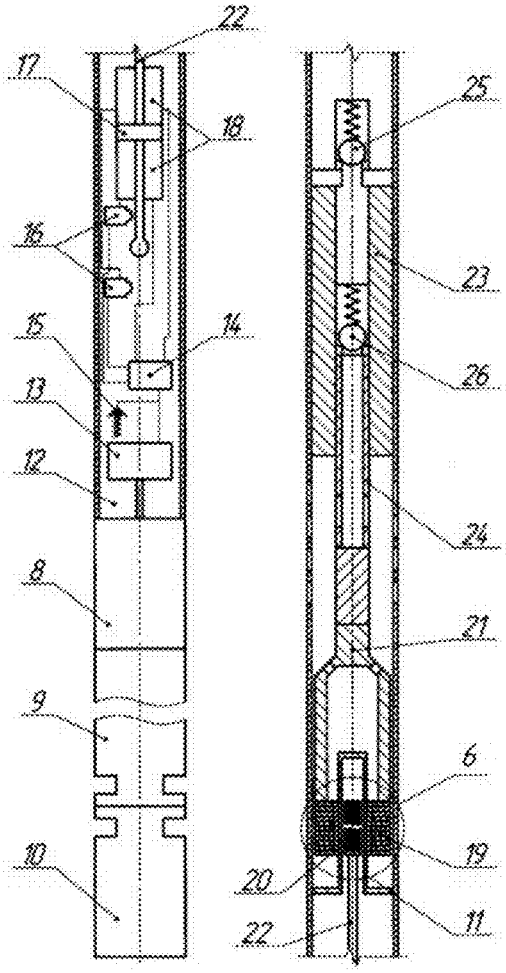
Figure 3:
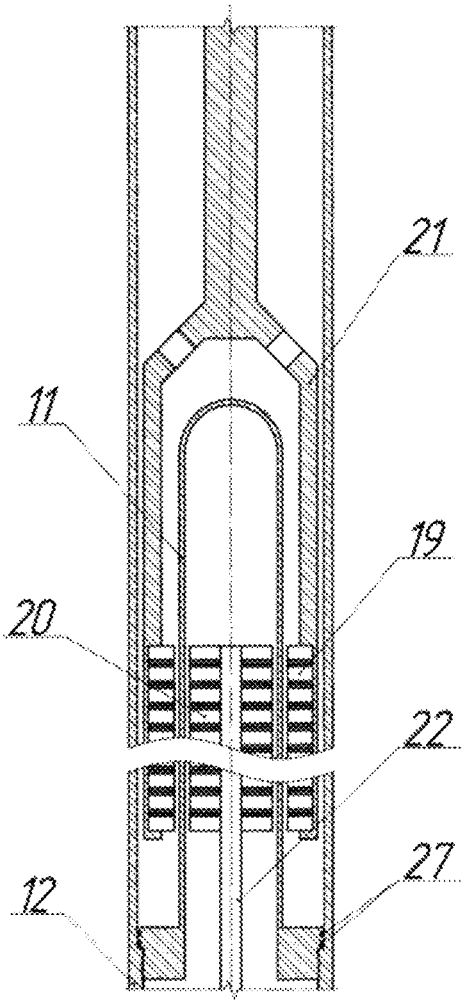

The essence of the invention is explained in the following figures that show the claimed unit:

FIG. 1. General view of the claimed unit in a set with other equipment;

FIG. 2. Submersible part of the unit;

FIG. 3. Linear magnetic coupling.

The figures show the following:

1. Control station
2. Transformer
3. Submersible cable
4. Tubing
5. Submersible plunger pump
6. Linear magnetic coupling
7. Hydraulic motor
8. Hydroprotection unit of the electric motor
9. Submersible electric motor

10. Telemetry system
11. Media separator coupling
12. Oil tank
13. Oil pump
14. Hydraulic distribution valve
15. Safety valve
16. Cam valve
17. Hydraulic cylinder piston 18
18. Hydraulic cylinder of hydraulic motor 7
19. Magnets of the external cylinder of coupling 6
20. Magnets of the internal cylinder of coupling 6
21. Pusher
22. Hydraulic motor rod
23. Pump cylinder 5
24. Pump rod 5
25. Discharge valve of pump 5
26. Suction valve of pump 5
27. Rubber seals of the media separator of the coupling.

The following describes the use of the unit in its preferred embodiment, which does not limit the legal protection of the invention.

The claimed unit is connected, via submersible cable 3 and step-up transformer 2, to control station 1. A submersible telemetry unit can be installed at the lower part of submersible motor 9 to monitor the motor parameters and downhole conditions 10. The cam valves can be installed on the suction line for the forced generation of pressure in hydraulic distributor 14 for its switching, and the brake valves can be installed on the discharge line to eliminate the backflow of hydraulic fluid and reduce the load on the hydraulic distributor valve.

The unit pumps the reservoir fluid as follows.

Pusher 21, which is made in the form of a hollow rod, is connected to rod 24 of plunger pump 5. During the operation of the unit, there is a reciprocating motion of hydraulic motor 7 rod 22, which is transmitted to plunger pump 5 rod 24 through pusher 21 due to the restraining forces generated between the coupling magnets 6, which results in the operation of plunger pump 5. The coupling ensures that the force is transmitted to plunger pump 5 from hydraulic motor 7.

To ensure that the inner space of submersible electric motor 9 and hydraulic motor 7 is sealed, the unit comprises a media separator 11 of coupling 6. In the inner cavity of the media separator, there are magnets 20 of the internal cylinder of magnetic coupling 6, that are firmly secured on the upper rod of hydraulic motor 7 and, on the outer side of the media separator, there are magnets 19 of the external cylinder of the magnetic coupling 6 which, in turn, are located within the pusher and are firmly secured on pusher 21. The media separator is in the form of a tube with a plug on one side and has a threaded part with rubber seals on the other side or is welded to the oil tank. In the first case, media separator 11 is secured to the oil tank by a threaded portion, wherein rubber seals 27 inserted into the grooves of the threaded portion of media separator 11 are pressed against the inner surface of oil tank 12 and ensure sealing. The oil pressure inside the submersible electric motor and oil tank is balanced with the pressure of the reservoir fluid. This can be ensured, for example, by the hydroprotection unit of the electric motor or a piston-type or diaphragm-type compensator, as well as by using it in conjunction with the standard hydroprotection for electric-driven centrifugal pumps.

This ensures a complete sealing of the hydraulic motor and submersible electric motor.

The invention claimed is:

1. A submersible pump unit comprising a submersible electric motor kinematically connected to an oil pump, a submersible plunger pump with a rod, a hydraulic motor with a rod, wherein such hydraulic motor is located within an oil tank, and the bottom-end cavities of the hydraulic motor are connected, through a hydraulic distribution valve, to suction and discharge lines of the oil pump, and characterized in that there is a linear magnetic coupling with media separator placed between the hydraulic motor and the submersible plunger pump and made in the form of two cylinders, (external and internal), one of which is placed inside the other, wherein each cylinder is made by permanent magnets which have alternating direction of magnetization and are placed one above the other, wherein the magnets of the internal cylinder are firmly secured on the upper end of the hydraulic motor rod, and the magnets of the external cylinder are firmly secured on a pusher placed inside the external cylinder, and the pusher is made in the form of a hollow rod connected to the plunger pump rod, wherein the media separator is made in the form of a tube with a plug on one side, and on the other side the media separator is hermetically connected to the oil tank body by welding or secured to the oil tank by means of a connection thread with grooves with installed rubber seals to ensure hermetic sealing to the inner surface of the oil tank, wherein the magnets of the internal cylinder of the coupling are located in the inner cavity of the media separator, and the magnets of the external cylinder are located on the outer side of the media separator, and there are intermediate rings of steel placed between the magnets of each cylinder of the coupling, and the oil pressure inside the submersible electric motor and oil tank is balanced with the pressure of the reservoir fluid.

* * * * *